US007022659B2

(12) United States Patent
Duquet et al.

(10) Patent No.: US 7,022,659 B2
(45) Date of Patent: Apr. 4, 2006

(54) PACKAGED UNIT DOSE OF DETERGENT AND METHOD OF TREATING FABRICS

(75) Inventors: Jacky Pierre Duquet, Herbeville (FR); Jose Luis Vega, Strombeek-Bever (BE); Jean Wevers, Steenhuffel (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/278,239

(22) Filed: Oct. 23, 2002

(65) Prior Publication Data

US 2003/0050208 A1 Mar. 13, 2003

Related U.S. Application Data

(63) Continuation of application No. PCT/US01/13456, filed on Apr. 25, 2001, and a continuation of application No. PCT/US01/07710, filed on Mar. 9, 2001.

(30) Foreign Application Priority Data

| | | |
|---|---|---|
| Apr. 27, 2000 | (EP) | 00870086 |
| Apr. 28, 2000 | (GB) | 0010229 |
| Jul. 14, 2000 | (EP) | 00202542 |

(51) Int. Cl.
*C11D 17/04* (2006.01)
*C11D 3/37* (2006.01)
*D06L 1/00* (2006.01)

(52) U.S. Cl. ..... 510/439; 510/297; 510/298; 510/438; 510/446; 8/137

(58) Field of Classification Search ..... 510/297, 510/298, 439, 446, 438; 8/137
See application file for complete search history.

(56) References Cited

U.S. PATENT DOCUMENTS

| | | | | |
|---|---|---|---|---|
| 3,947,971 | A * | 4/1976 | Bauer | 34/60 |
| 4,115,292 | A * | 9/1978 | Richardson et al. | 510/392 |
| 4,348,293 | A * | 9/1982 | Clarke et al. | 510/296 |
| 4,532,063 | A * | 7/1985 | Gueldenzopf | 252/186.35 |
| 4,582,625 | A * | 4/1986 | George | 15/104.93 |
| 4,795,032 | A * | 1/1989 | Kandathil | 8/137 |
| 5,085,892 | A * | 2/1992 | Corona et al. | 427/365 |
| 5,783,541 | A * | 7/1998 | Tack et al. | 510/224 |

FOREIGN PATENT DOCUMENTS

| | | | |
|---|---|---|---|
| DE | 199 34 254 A1 | | 1/2001 |
| JP | 04057989 A | * | 2/1992 |
| WO | WO 01/00781 | | 1/2001 |

* cited by examiner

*Primary Examiner*—Lorna M. Douyon
(74) *Attorney, Agent, or Firm*—Armina E. Matthews; Mark A. Charles; Kim W. Zerby

(57) ABSTRACT

Packages which comprise a substrate and one or more fabric treatment chemicals, wherein the fabric treatment chemicals are released from the substrate through the action of temperature, friction and/or contact with water. Methods for treating fabrics, the methods comprising the step of opening a package, the package containing at least one unit dose of detergent, and subsequently dissolving and/or dispersing the detergent composition to provide a wash liquor, and wherein the package comprises an insoluble substrate and one or more fabric treatment chemicals, the chemical-containing substrate being used to directly or indirectly apply the fabric treatment chemicals to the fabrics.

14 Claims, No Drawings

PACKAGED UNIT DOSE OF DETERGENT AND METHOD OF TREATING FABRICS

CROSS REFERENCE TO RELATED APPLICATIONS

This application is a continuation of PCT/US01/07710 filed Mar. 9, 2001 and is a continuation of International Application PCT/US01/13456 with an international filing date of Apr. 25, 2001, published in English under PCT Article 21(2) which claims benefit of European Application No. 00870086.6, filed Apr. 27, 2000, and European Application No. 00202542.7, filed Jul. 14, 2000.

A package for containing at least one unit dose of a detergent composition, such as packaged detergent tablets. The present invention further relates to a method of use of the package.

Laundry detergents have long been known in the form of tablets (i.e. a unit dose) packaged into a polymeric film. An early commercial of this was Procter & Gamble's Salvo® tablets which were sold in the United States in the 1960's. In one commercially marketed execution, four Salvo® tablets were sealed within a polyethylene film. More recently automatic dish washing tablets have been presented to the consumer in a similar package. Laundry detergent tablets have also been presented commercially, for example in pairs, wrapped and sealed within a flow-wrap which is discarded after the package has been opened for use.

One of the disadvantages of such a package is that once the wrapping material has been opened by the consumer in order to gain access to the detergent tablets, the wrapping material serves no further purpose, and is simply discarded. Evidently, this is wasteful.

SUMMARY OF THE INVENTION

The present invention avoids this wastefulness by providing a package which comprises a substrate and one or more fabric treatment chemicals, wherein the fabric treatment chemicals are released from the substrate through the action of temperature, friction and/or contact with water. The package may then be used to apply the fabric treatment chemicals either directly to fabrics, or via the wash liquor, or in the dryer; wherein the fabric treatment chemicals are active during the laundry washing and/or drying processes and/or provide a residue on laundered fabrics.

Preferred chemicals for use in the package of the present invention are a) a surfactant and/or solvent for stain pre-treatment; or b) a fabric softening agent; or c) a fabric integrity ingredient.

The present invention also provides a method for treating fabrics, the method comprising the step of opening a package, the package containing at least one unit dose of detergent, and subsequently dissolving and/or dispersing the detergent composition to provide a wash liquor, and wherein the package comprises an insoluble substrate and one or more fabric treatment chemicals, the chemical-containing substrate being used to directly or indirectly apply the fabric treatment chemicals to the fabrics. Preferably the method of the present invention comprises one of the steps of:

a) pretreating stains on the fabrics with the chemical-containing substrate, before washing the fabrics with the wash liquor comprising the detergent composition;

b) adding the chemical-containing substrate to the wash liquor, the wash liquor comprising the detergent composition; or c) adding the chemical-containing substrate to the dryer, after washing the fabrics with the wash liquor comprising the detergent composition.

DETAILED DESCRIPTION OF THE INVENTION

The detergent composition useful in the present invention may comprise any chemical components which are useful in laundry, especially but not exclusively domestic laundry; as well as process aids and other auxiliaries known in the laundry field.

By unit dose it is meant herein a predetermined amount of detergent composition, preferably in the tablet form.

Preferably the substrate is insoluble, by which it is meant herein that at least 50% by weight of the substrate does not dissolve in water at 20° C. and pH 7 for a period of at least 24 hours. Preferably 90%, and more preferably 99%, by weight of the substrate does not dissolve in water at 20° C. and pH 7 for a period of at least 24 hours.

The insoluble substrate may be formed from a sheet of flexible material. Materials suitable for use as a flexible sheet include mono-layer, co-extruded or laminated films. Such films may comprise various components, such as polyethylene, polypropylene, polystyrene, polyethylene-terephtalate. Preferably, the insoluble substrate comprises, or consists essentially of, a polyethylene and bi-oriented-polypropylene co-extruded film with an MVTR of less than 5 g/day/$m^2$. The package is preferably sealed around the at least one unit dose of the detergent composition so that the package is substantially impermeable to moisture so that the MVTR of the package is preferably of less than 10 g/day/$m^2$, more preferably of less than 5 g/day/$m^2$, even more preferably of less than 1 g/day/$m^2$. The film may have various thicknesses. The thickness should typically be between 10 and 150 μm, preferably between 15 and 120 μm, more preferably between 20 and 100 μm, even more preferably between 25 and 80 μm and most preferably between 30 and 40 μm.

Alternative insoluble substrates may also be formed from cellulosic or other polymeric material by methods such as wet-laying, air-laying or hydroentangling.

The insoluble substrate preferably comprises a barrier layer typically found with packaging materials having a low oxygen transmission rate, typically of less than 300 $cm^3/m^2$/day, preferably of less than 150 $cm^3/m^2$/day, more preferably of less than 100 $cm^3/m^2$/day, even more preferably of less than 50 $cm^3/m^2$/day and most preferably of less than 10 $cm^3/m^2$/day. Typical materials having such barrier properties include bi-oriented polypropylene, polyethylene terephthalate, polyamide, poly(ethylene vinyl alcohol), or laminated materials comprising one of these, as well as SiOx (Silicium oxides), or metallic foils such as aluminium foils for example. Such packaging material may have a beneficial influence on the stability of the product during storage for example.

Another suitable type of substrate, optionally in combination with the type of substrate described above, are those that are adapted to soften fabrics in an automatic laundry dryer, of the types disclosed in U.S. Pat. No. 3,989,631, Marsan, issued Nov. 2, 1976; U.S. Pat. No. 4,055,248, Marsan, issued Oct. 25, 1977; U.S. Pat. No. 4,073,996, Bedenk et al., issued Feb. 14, 1978; U.S. Pat. No. 4,022,938, Zaki et al., issued May 10, 1977; U.S. Pat. No. 4,764,289, Trinh, issued Aug. 16, 1988; U.S. Pat. No. 4,808,086, Evans et al., issued Feb. 28, 1989; U.S. Pat. No. 4,103,047, Zaki et al., issued Jul. 25, 1978; U.S. Pat. No. 3,736,668, Dillarstone, issued Jun. 5, 1973; U.S. Pat. No. 3,701,202, Compa et al., issued Oct. 31, 1972; U.S. Pat. No. 3,634,947, Furgal, issued Jan. 18, 1972; U.S. Pat. No. 3,633,538, Hoeflin, issued Jan. 11, 1972; and U.S. Pat. No. 3,435,537, Rumsey, issued Apr. 1, 1969; and U.S. Pat. No. 4,000,340, Murphy et al., issued Dec. 28, 1976, all of said patents being incorporated herein by reference.

In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the fabric softener composition and then is dispersed and/or exhausted from the dryer.

The dispensing means will normally carry an effective amount of fabric treatment composition. Such effective amount typically provides sufficient fabric conditioning/antistatic agent and/or anionic polymeric soil release agent for at least one treatment of a minimum load in an automatic laundry dryer. Amounts of fabric treatment composition for multiple uses, e.g., up to about 30, can be used.

Typical amounts for a single article can vary from about 0.25 g to about 100 g, preferably from about 0.5 g to about 20 g, most preferably from about 1 g to about 10 g.

Highly preferred paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Typically each unit dose comprises between 10 g and 100 g of active components, more preferably between 30 g and 60 g. The consumer may be guided by usage instructions to use two unit doses for an averagely soiled laundry load, to use three unit doses for a heavily soiled load. One unit dose may be used for a very lightly soiled load or for a half load. Most commonly on the market today, the primary package (for example a cardboard box or carton) contains enough unit doses ("N" unit doses) for several wash loads; and the unit doses are additionally packaged in pairs within a plurality of secondary packages (referred to herein as the insoluble substrate; for example a plastic or metallic flow-wrap). One inconvenience of this arrangement is that when a consumer has a heavily soiled load, and wishes to use three tablets, it is necessary to open the secondary packaging of two pairs of unit doses in order to use the required three unit doses, and as a consequence to retain one unwrapped but unused unit dose for subsequent use. One solution to this problem, irrespective of whether or not the secondary packaging is an insoluble substrate which has been treated according to the teaching of the present invention, is to wrap N unit doses in a plurality, A+B, of secondary packages, so that a predetermined number of unit doses are packed in pairs, to give A packages comprising pairs of unit doses, and to wrap a predetermined number of unit doses in threes, to give B packages each comprising three unit doses, and finally to pack these secondary packages into the primary package. The values for "A" and "B" can be predetermined according to known consumer habits.

In general:

$$N=(A\times n_1)+(B\times n_2)+$$

where N, A, B, $n_1$, $n_2$ . . . are each integers and wherein $n_1 \neq n_2$. Preferably wherein $n_1$, $n_2$ . . each 2, or greater. Most preferably $N=(A\times n_1)+(B\times n_2)$, and $n_1=2$, and $n_2=3$; in this case greater than, or equal to 5, preferably N is greater than 10, more preferably N is from 20 to 150, and most preferably N is between 24 and 128.

For example, a primary package containing 32 unit doses may comprise 10 flow-wrapped secondary packages each containing 2 unit doses and 4 flow-wrapped secondary packages each containing 3 unit doses. In this example: N=32, A=10, B=4, $n_1=2$, and $n_2=3$.

Among the (secondary) packing methods preferred for use in the present invention are the wrapping methods disclosed in WO92/20593, including flow wrapping or over wrapping. When using such processes, a longitudinal seal is provided, which may be a fin seal or an overlapping seal, after which a first end of the package is closed with a first end seal, followed by closure of the second end with a second end seal.

In a preferred embodiment of the present invention the package further comprises a means for opening the sealed package. Furthermore, the package may optionally comprise re-closing means as described in WO92/20593. In particular, using a twist, a cold seal or an adhesive is particularly suited. Indeed, a band of cold seal or a band of adhesive may be applied to a surface of the package at a position adjacent to the second end of the package, so that this band may provide both the initial seal and re-closure of the package. In such a case the adhesive or cold seal band may correspond to a region having a cohesive surface, i.e. a surface which will adhere only to another cohesive surface. Such re-closing means may also comprise spacers which will prevent unwanted adhesion. Such spacers are described in WO95/13225, published on May 18, 1995. There may also be a plurality of spacers and a plurality of strips of adhesive material. The main requirement is that the communication between the exterior and the interior of the package should be minimal, even after first opening of the package. A cold seal may be used, and in particular a grid of cold seal, whereby the cold seal is adapted so as to facilitate opening of the package.

The chemicals preferred for use in the present invention in combination with the insoluble substrate include:

a) a surfactant and/or solvent for stain pre-treatment;

b) a fabric softening agent, including cationic surfactants and nonionic surfactants;

c) a fabric integrity ingredient, including carboxymethyl celluloses;

A highly preferred component of the detergent composition present on the substrate for use herein is a solvent. More preferred solvents are defined in terms of Hansen parameters. A hydrophobic solvent as defined herein is considered to be a solvent having Hansen hydrogen bonding cohesion parameter dH below 18 $(\text{Joule/cm}^3)^{0.5}$. Preferred hydrophobic solvents have a Hansen hydrogen bonding cohesion parameter dH below 12 $(\text{Joule/cm}^3)^{0.5}$. and a Hansen polar parameter dP below 8 $(\text{Joule/cm}^3)^{0.5}$.

Preferred solvents for use comprise mixture of hydrocarbons with a flash point no lower than 70° C. and aliphatic fatty acid esters. More preferred solvents would be alkanes or alkenes with a chain length above C7, and particularly alkanes and alkenes with a chain length above C12.

Particularly preferred hydrophobic solvents are terpenes, paraffins; isoparaffins; naphtenes; aromatics; and olefins. Solvents are used in the detergent compositions of the present invention preferably at a level of from 3% to 90%, more preferably from 4% to 45%, and most preferably from 5% to 25% by weight of the detergent composition.

Other solvents having a Hansen parameter of dH less than 18 $(\text{Joule/cm}^3)^{0.5}$ include glycol ethers, more preferably glycol ethers based upon ethylene oxide, propylene oxide, or mixtures thereof. Such solvents may, and preferably are, used in combination with either short chain surfactants, long chain surfactants, or mixtures thereof.

In one embodiment of the invention the hydrophobic solvents defined above are used in combination with mixtures of short chain and long chain surfactants having preferably and overall HLB value of from 2 to 16, and more preferably from 8 to 14. Preferred molar ratio of short-chain to long chain ratios are from 1:10 to 10:1, more preferably between 1:3 and 3:1, most preferably about 1:1.

Surfactants are preferably present at a level of from 1 to 50%, more preferably 10 to 40% and most preferably 15 to 30% by weight of the detergent composition.

Short chain surfactants are surfactants which compromise a C6–C10 alkyl chain as their hydrophobic portion. Preferred short-chain surfactants for use are the C4–C8 fatty alcohol polyglycol ethers with 2–5 EO. C6–C8 alkyl sulphonates, C6–C8 alkyl sulphates, C6–C8 alkyl ethoxy sulphates, C6–C10 betaines or C6–C10 amine oxides could also be useful.

Water-soluble nonionic surfactants are also useful as surfactants in the compositions of the invention. Indeed, preferred processes use anionic/nonionic blends. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 1 to 25 moles of ethylene oxide per mole of alcohol, especially 2 to 7 moles of ethylene oxide per mole of alcohol. Particularly preferred are the condensation products of alcohols having an alkyl group containing from about 9 to 15 carbon atoms; and condensation products of propylene glycol with ethylene oxide.

Other preferred nonionics are polyhydroxy fatty acid amides which my be prepared by reacting a fatty acid ester and an N-alkyl polyhydroxy amine. The preferred amine for use in the present invention is N-(R1)-CH2(CH20H)4-CH2-OH and the preferred ester is a C12–C20 fatty acid methyl ester. Most preferred is the reaction product of N-methyl glucamine (which may be derived from glucose) with C12–C20 fatty acid methyl ester.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the groups consisting of alkyl and hydroxyalkyl moieties of from about 1 to 3 carbon atoms.

Examples of cationic surfactants which are suitable for use as a component of the package in the present invention include cationic quaternary ammonium compounds and imidazolium compounds. In a preferred embodiment of the present invention, the fabric softening agent comprises from about 5% to about 95% preferably from about 15% to about 90%, more preferably from about 25% to about 85%, and even more preferably from about 25% to about 55%, of biodegradable cationic surfactant, preferably an ester quaternary ammonium compound (EQA).

The EQA of the present invention is selected from Formulas I, II, III, and mixtures thereof.

Formula I comprises:

$$(R)_{4-m}—N^+—[(CH_2)_n—Y—R^2]_mX^-$$

wherein each Y═—O—C(O)—, or —C(O)—O—; m=1 to 3; each n=is an integer from 1 to 4, and mixtures thereof; each R substituent is a short chain C1 –C6, preferably C1 –C3, alkyl group, e.g., methyl, ethyl, propyl, and the like; a short chain C1–C4 hydroxy alkyl group; benzyl; or mixtures thereof, with, preferably, at least one R group being short chain alkyl, preferably methyl; each $R^2$ is a long chain, saturated and/or unsaturated (IV of from about 3 to about 60), C8–C30 hydrocarbyl, or substituted hydrocarbyl substituent, preferably straight or branched alkyl or alkenyl chain, preferably containing from about 14 to about 18 carbon atoms, more preferably straight chain, or mixtures thereof; and the counterion, $X^-$, can be any softener-compatible anion, for example, methylsulfate, ethylsulfate, chloride, bromide, formate, sulfate, lactate, nitrate, benzoate, and the like, preferably methylsulfate.

Tallow is a convenient and inexpensive source of long chain alkyl and alkenyl materials. It will be understood that substituents R and $R^2$ of Formula I can optionally be substituted with various groups such as alkoxyl or hydroxyl groups. The preferred compounds can be considered to be diester (DEQA) variations of ditallow dimethyl ammonium methyl sulfate (DTDMAMS), which is a widely used fabric softener. At least 80% of the DEQA is in the diester form, and from 0% to about 20%, preferably less than about 10%, more preferably less than about 5%, can be EQA monoester (e.g., only one —Y—$R^2$ group).

The following are non-limiting examples of EQA Formula I (wherein all long-chain alkyl substituents are straight-chain):

Saturated $[C2H5]_2{}^+N[CH2CH2OC(O)C17H35]_2(CH3SO4)^-$
$[CH3][C2H5]^+N[CH2CH2OC(O)C13H27]_2[HC(O)O]^-[C3H7][C2H5]^+N[CH2CH2OC(O)C11H23]_2(CH3SO4)^-[CH3]_2{}^+N\text{-}[CH2CH2OC(O)C17H35]CH2CH2OC(O)C15H31(CH3SO4)^-$
$[CH3]_2{}^+N[CH2CH2OC(O)R2]_2(CH3SO4)^-$ where—C(O)R2 is derived from saturated tallow.

Unsaturated $[CH3]_2{}^+N[CH2CH2OC(O)C17H33]_2(CH3SO4)^-$
$[C2H5]_2{}^+N[CH2CH2OC(O)C17H33]_2Cl^-[CH3]$
$[C2H5]^+N[CH2CH2OC(O)C13H25]_2[C6H5C(O)O]^-[CH3]_2{}^+N—[CH2CH2OC(O)C17H33]CH2CH2OC(O)C15H29(CH3CH2SO4)^-[CH3]_2{}^+N[CH2CH2OC(O)R2]_2(CH3SO4)^-$ where —C(O)R2 is derived from partially hydrogenated tallow or modified tallow having the characteristics set forth herein.

Other specific examples of biodegradable Formula I compounds suitable for use in the fabric softening agents herein are: N-methyl-N,N-di-(2-C14–C18-acyloxy ethyl), N-2-hydroxyethyl ammonium methylsulfate; [HO—CH(CH3)CH2][CH3]+N[CH2CH2OC(O)C15H31]2Br—; [HO—CH(CH3)CH2][CH3]+N[CH2CH2OC(O)C15H29]2[HC(O)O]—; and [CH2CH2OH][CH3]+N[CH2CH2OC(O)R2]2(CH3SO4)-. A preferred compound is N-methyl, N,N-di-(2-oleyloxyethyl) N-2-hydroxyethyl ammonium methylsulfate.

In addition to Formula I compounds, the compositions and articles of the present invention comprise EQA compounds of Formula II:

(R1)3-+N—(CH2)*n*—C(YR2)H—C(YR2)H2X— wherein, for any molecule:

each Y is —O—C(O)— or —C(O)—O—; each R1 is C1–C4 alkyl or hydroxy alkyl; R2 and n are defined hereinbefore for Formula I; and wherein preferably R1 is a methyl group, n is 1, Y is —O—C(O)—, each R2 is C14–C18, more preferably straight chain; and X— is methyl sulfate.

A specific example of a biodegradable Formula II EQA compound suitable for use in the aqueous fabric softening compositions herein is: 1,2-bis(tallowyl oxy)-3-trimethyl ammoniopropane methylsulfate (DTTMAPMS).

Other examples of suitable Formula II EQA compounds of this invention are obtained by, e.g., replacing "tallowyl" in the above compounds with, for example, cocoyl, lauryl, oleyl, stearyl, palmityl, or the like; replacing "methyl" in the above compounds with ethyl, propyl, isopropyl, butyl, isobutyl, t-butyl, or the hydroxy substituted analogs of these radicals; replacing "methylsulfate" in the above compounds with chloride, ethylsulfate, bromide, formate, sulfate, lactate, nitrate, and the like, but methylsulfate is preferred.

Fabric conditioning agent useful in the present invention can also comprise Formula III compounds:

$(R)_{4-m}—N^+—[(CH2)_n—Y—R^2]_mX^-$

R, $R^2$, m, n, and X— are previously defined in Formula I; and each Y=—NH—C(O)—; —C(O)—NH—; —C(O)—O—; and —O—C(O)—; wherein at least one Y group is —NH—C(O)—or —C(O)—NH—. An example of this compound is methyl bis (oleyl amidoethyl) 2-hydroxyethyl ammonium methyl sulfate.

The cationic surfactants herein can be prepared by standard esterification and quaternization reactions, using readily available starting materials. General methods for preparation are disclosed in U.S. Pat. No. 4,137,180, incorporated herein by reference.

As used herein, when the diester quat is specified, it will include the monoester quat that is normally present. For the optimal antistatic benefit the percentage of monoester quat should be as low as possible, preferably less than about 20%. The level of monoester quat present can be controlled in the manufacturing of the EQA.

EQA compounds prepared with fully saturated acyl groups are rapidly biodegradable and excellent softeners. However, it has been discovered that compounds prepared with at least partially unsaturated acyl groups have advantages (i.e., antistatic benefits) and are highly acceptable for consumer products when certain conditions are met.

Variables that must be adjusted to obtain the benefits of using unsaturated acyl groups include the Iodine Value (IV) of the fatty acids, the odor of fatty acid starting material, and/or the EQA. Any reference to IV values herein refers to IV of fatty acyl groups and not to the resulting EQA compound.

Antistatic effects are especially important where the fabrics are dried in a tumble dryer, and/or where synthetic materials which generate static are used. As the IV is raised, there is a potential for odor problems.

Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care should be taken to minimize the adverse results of contact of the resulting fatty acyl groups with oxygen and/or bacteria by adding antioxidants, antibacterial agents, etc. The additional expense and effort associated with the unsaturated fatty acyl groups is justified by the superior performance.

Generally, hydrogenation of fatty acids to reduce polyunsaturation and to lower IV to insure good color and odor stability leads to a high degree of trans configuration in the molecule. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc.

It has also been found that for good chemical stability of the diester quaternary compound in molten storage, water levels in the raw material must be minimized to preferably less than about 1% and more preferably less than about 0.5%. Storage temperatures should be kept as low as possible and still maintain a fluid material, ideally in the range of from about 49° C. to about 75° C. The optimum storage temperature for stability and fluidity depends on the specific IV of the fatty acid used to make the diester quaternary and the level/type of solvent selected. Also, exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

The fabric conditioning agent optionally further comprises ethoxylated and/or propoxylated sugar derivative containing a "sugar" moiety, e.g., a moiety derived from, e.g., a polyhydroxy sugar, or sugar alcohol, that contains from about 4 to about 12 hydroxy groups. This sugar moiety is substituted by at least one long hydrophobic group, containing from about 8 to about 30 carbon atoms, preferably from about 16 to about 18 carbon atoms. For improved physical characteristics, e.g., higher melting point, the hydrophobic group can contain more carbon atoms, e.g., 20–22, and/or there can be more than one hydrophobic group, preferably two or, less preferably, three. In general, it is preferred that the hydrophobic group is supplied by esterifying one of the hydroxy groups with a fatty acid. However, the hydrophobic group can be supplied by connecting the hydrophobic group to the sugar moiety by an ether linkage, and/or a moiety containing a carboxy group esterified with a fatty alcohol can be attached to the sugar moiety to provide the desired hydrophobic group.

Sugar moieties include sucrose, galactose, mannose, glucose, fructose, sorbitan, sorbitol, mannitol, inositol, etc., and/or their derivatives such as glucosides, galactosides, etc. Other "sugar" types of moieties containing multiple hydroxy groups can also be used including starch fractions and polymers such as polyglycerols. The sugar moiety can be any polyhydroxy group that provides the requisite number/density of hydroxy groups approximating that of conventional sugar moieties.

The hydrophobic group can be provided by attachment with an ester, ether, or other linkage that provides a stable compound. The hydrophobic group is preferably primarily straight chain, and preferably contains some unsaturation to provide additional antistatic benefits. Such hydrophobic groups and their sources are well known, and are described hereinafter with respect to the more conventional types of softening agents.

The polyalkoxy chain can be all ethoxy groups, and/or can contain other groups such as propoxy, glyceryl ether, etc., groups. In general, polyethoxy groups are preferred, but for improved properties such as biodegradability, glyceryl ether groups can be inserted. Typically there are from about 4 to about 100, preferably from about 10 to about 40, more preferably from about 15 to about 30, ethoxy groups, or their equivalents, per molecule.

An empirical formula is as follows:

Rm—(sugar)(R1 O)n wherein R is a hydrophobic group containing from about 8 to about 30, preferably from about 12 to about 22, more preferably from about 16 to about 18 carbon atoms; "sugar" refers to a polyhydroxy group, preferably derived from a sugar, sugar alcohol, or similar polyhydroxy compound; R1 is an alkylene group, preferably ethylene or propylene, more preferably ethylene; m is a number from 1 to about 4, preferably 2; and n is a number from about 4 to about 100, preferably from about 10 to about 40. (R1 O)n can be attached to a sugar moiety or link a sugar moiety and R. Preferred compounds of this type are polyethoxylated sorbitan monostearate and polyethoxylated sorbitan tristearate, e.g., Glycosperse S-20 and Glycosperse TS-20, respectively, from Lonza, each of which contain about 20 ethoxylate moieties per molecule, and mixtures thereof.

The level of the polyethoxy sugar derivative is typically at least about 2%, preferably at least about 10%. Preferably the maximum level is no more than about 90%, more preferably no more than about 75%.

The polyethoxy sugar derivative provides improved antistatic properties to the compositions and can provide equivalent antistatic properties to conventional dryer added compositions, and/or articles, even with less, or no, quaternary ammonium softener materials present. It is possible to prepare a dryer-added composition, or article, that is entirely nonionic.

Fabric softening agents employed herein optionally contain, as a preferred component, at a level of from 0% to about 95%, preferably from about 10% to about 75%, more preferably from about 20% to about 60%, carboxylic acid salt of a tertiary amine which has the formula:

R5-N(R6)(R7)-H(+)(−)O—C(O)—R8 wherein R5 is a long chain aliphatic group containing from about 8 to about 30 carbon atoms; R6 and R7 are the same or different from each other and are selected from the group consisting of aliphatic groups containing from about 1 to about 30 carbon atoms, hydroxyalkyl groups of the Formula R4 OH wherein R4 is an alkylene group of from about 2 to about 30 carbon atoms, and alkyl ether groups of the formula R9 (OCn H2n)m wherein R9 is alkyl and alkenyl of from about 1 to about 30 carbon atoms and hydrogen, each n is 2 or 3, and m is from about 1 to about 30, and wherein R8 is selected from the group consisting of unsubstituted alkyl, alkenyl, aryl, alkaryl and aralkyl of about 1 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl, said composition having a melting point of from about 35° C. to about 100° C.

This component can provide the following benefits: superior odor, a decrease in paint softening of the dryer drum, and/or improved fabric softening performance, compared to similar articles without this component. Either R5, R6, R7, and/or R8 chains can contain unsaturation for improved antistatic benefits.

Tertiary amine salts of carboxylic acids have superior chemical stability, compared to primary and secondary amine carboxylate salts. For example, primary and secondary amine carboxylates tend to form amides when heated, e.g., during processing or use in the dryer. Also, they absorb carbon dioxide, thereby forming high melting carbamates which build up as an undesirable residue on treated fabrics.

Preferably, R5 is an aliphatic chain containing from about 12 to about 30 carbon atoms, R6 is an aliphatic chain of from about 1 to about 30 carbon atoms, and R7 is an aliphatic chain of from about 1 to about 30 carbon atoms. Particularly preferred tertiary amines for static control performance are those containing unsaturation; e.g., oleyldimethylamine and/or soft tallowalkyldimethylamine.

Examples of preferred tertiary amines as starting material for the reaction between the amine and carboxylic acid to form the tertiary amine salts are: lauryldimethylamine, myristyldimethylamine, stearyldimethylamine, tallowalkyldimethylamine, coconutalkyldimethylamine, dilaurylmethylamine, distearylmethylamine, ditallowalkylmethylamine, oleyldimethylamine, dioleyl methylamine, lauryldi(3-hydroxypropyl)amine, stearyldi(2-hydroxyethyl)amine, trilaurylamine, laurylethylmethylamine, and C18H37N[(OC2H4)10OH]2.

Preferred fatty acids are those wherein R8 is a long chain, unsubstituted alkyl or alkenyl group of from about 8 to about 30 carbon atoms, more preferably from about 11 to about 17 carbon atoms.

Examples of specific carboxylic acids as a starting material are: formic acid, acetic acid, lauric acid, myristic acid, palmitic acid, stearic acid, oleic acid, oxalic acid, adipic acid, 12-hydroxystearic acid, benzoic acid, 4-hydroxybenzoic acid, 3-chlorobenzoic acid, 4-nitrobenzoic acid, 4-ethylbenzoic acid, 4-(2-chloroethyl)benzoic acid, phenylacetic acid, (4-chlorophenyl)acetic acid, (4-hydroxyphenyl)acetic acid, and phthalic acid.

Preferred carboxylic acids are stearic, oleic, lauric, myristic, palmitic, and mixtures thereof.

Preferred amine salts for use herein are those wherein the amine moiety is a C8–C30 alkyl or alkenyl dimethyl amine or a di-C8–C30 alkyl or alkenyl methyl amine, and the acid moiety is a C8–C30 alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyldimethylamine stearate, stearyldimethylamine tallowate, stearyldimethylamine myristate, stearyldimethylamine palmitate, distearylmethylamine palmitate, distearylmethylamine laurate, and mixtures thereof. A particularly preferred mixture is oleyldimethylamine stearate and distearylmethylamine myristate, in a ratio of 1:10 to 10:1, preferably about 1:1.

Fabric conditioning agents useful in the present invention optionally further comprise unsaturated fatty acid. The unsaturated fatty acid is preferably present in the fabric conditioning agents herein at a level of from about 1% to about 15%, preferably from about 3% to about 12%.

Preferred fatty acids are those containing a long chain, unsubstituted alkenyl group of from about 8 to about 30 carbon atoms, more preferably from about 11 to about 17 carbon atoms. Examples of specific carboxylic acids are: oleic acid, linoleic acid, and mixtures thereof. These unsaturated fatty acids can be used in combination with saturated fatty acids like stearic, palmitic, and/or lauric acids.

Preferred carboxylic acids are oleic, linoleic, tallow fatty acids, and mixtures thereof.

A highly preferred optional ingredient is a nonionic fabric softening agent/material other than those disclosed hereinbefore. Typically, such nonionic fabric softener materials have an HLB of from about 2 to about 9, more typically from about 3 to about 7. In general, the materials selected should be relatively crystalline, higher melting (e.g., >25° C.). These materials can then improve processability of the composition.

The level of optional nonionic softener in the solid composition is typically from about 10% to about 50%, preferably from about 15% to about 40%.

Preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 16 to about 20, carbon atoms. Typical examples of said fatty acids being lauric acid, myristic acid, palmitic acid, stearic acid, oleic acid, and behenic acid. Typically, such softeners contain from about 1 to about 4, preferably about 2 fatty acid groups per molecule.

The polyhydric alcohol portion of the ester can be ethylene glycol, polyethylene glycol, (e.g., tetraethylene glycol), glycerol, poly (e.g., di-, tri-, tetra, penta-, and/or hexa-) glycerol, xylitol, sucrose, erythritol, pentaerythritol, sorbitol or sorbitan. These nonionic fabric softening materials do not include the ethoxylated sugar derivatives disclosed hereinbefore. They typically contain no more than about 4 ethoxy groups per molecule.

Highly preferred optional nonionic softening agents for use in the present invention are C10–C26 acyl sorbitan esters and polyglycerol monostearate. Sorbitan esters are esterified dehydration products of sorbitol. The preferred sorbitan ester comprises a member selected from the group consisting of C10–C26 acyl sorbitan monoesters and C10–C26 acyl sorbitan diesters and ethoxylates of said esters wherein one or more of the unesterified hydroxyl groups in said esters contain from 1 to about 4 oxyethylene units, and mixtures thereof. For the purpose of the present invention, sorbitan esters containing unsaturation (e.g., sorbitan monooleate) are preferred.

The foregoing types of complex mixtures of anhydrides of sorbitol are collectively referred to herein as "sorbitan". It will be recognized that this "sorbitan" mixture will also contain some free, uncyclized sorbitol.

Details, including formula, of the preferred sorbitan esters can be found in U.S. Pat. No. 4,128,484, incorporated hereinbefore by reference.

For the purposes of the present invention, it is preferred that a significant amount of di-, and tri-, and/or tetra-sorbitan esters are present in the ester mixture. Ester mixtures having from 20–50% mono-ester, 25–50% di-ester and 10–35% of tri-and tetra-esters are preferred.

The material which is sold commercially as sorbitan mono-ester (e.g., monostearate) does in fact contain significant amounts of di- and tri-esters and a typical analysis of commercial sorbitan monostearate indicates that it comprises about 27% mono-, 32% di- and 30% tri- and tetra-esters.

Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, sorbitan tristearate, and mixtures thereof, and mixed tallowalkyl sorbitan mono-, di-, and tri-esters.

The preferred sorbitan esters employed herein can contain up to about 15% by weight of esters of the C20–C26, and higher, fatty acids, as well as minor amounts of C8, and lower, fatty esters.

Glycerol and polyglycerol esters, especially glycerol, diglycerol, triglycerol, and polyglycerol mono- and/or diesters, preferably mono-, are also preferred herein (e.g., polyglycerol monostearate with a trade name of Radiasurf 7248).

Useful glycerol and polyglycerol esters include monoesters with stearic, oleic palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters.

Cyclodextrin/perfume complexes and free perfume can also be used in the present invention in combination with the insoluble substrate.

The package herein can also contain from about 0.5% to about 60%, preferably from about 1% to about 50%, cyclodextrin/perfume inclusion complexes, as disclosed in U.S. Pat. No. 5,139,687, Botcher et al., issued Aug. 18, 1992; and U.S. Pat. No. 5,234,610, Gardlik et al., issued Aug. 10, 1993, which are incorporated herein by reference. Perfumes are highly desirable, can usually benefit from protection, and can be complexed with cyclodextrin. Fabric softening products typically contain perfume to provide an olfactory aesthetic benefit and/or to serve as a signal that the product is effective.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference. Many of the art recognized perfume compositions are relatively substantive, as described hereinafter, to maximize their odor effect on substrates. However, it is a special advantage of perfume delivery via the perfume/cyclodextrin complexes that nonsubstantive perfumes are also effective. The volatility and substantivity of perfumes is disclosed in U.S. Pat. No. 5,234,610, supra.

If a package contains both free and complexed perfume, the escaped perfume from the complex contributes to the overall perfume odor intensity, giving rise to a longer lasting perfume odor impression.

As disclosed in U.S. Pat. No. 5,234,610, supra, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

Examples of fabric integrity ingredients which are suitable for use as a component of the package in the present invention include cellulose derivatives, such as those described in WO-A-9914245 (P&G) and WO-A-9914295 (P&G).

The unit dose detergent composition may comprise any ingredients which are useful for laundry purposes such as surfactants (anionic, nonionic, cationic, amphoteric, zwitterionic); builders (including phosphates, zeolites); polymers (including acrylic and maleic polymers and copolymers, carboxymethyl cellulose); bleach (such as perborate, percarbonate, and various bleach precursors); bleach activators (such as TAED); clay (such as bentonite); chelating agents; optical brightener; suds suppressor; enzymes; perfume. Various salts are also commonly used in detergent compositions for various purposes, some are builders in their own right, others are used as pH buffers or as fillers. The most common salts are carbonates, silicates (including SKS-6®), citrates and sulphates.

Preferably the various components are prepared in powdered or granular form and then mixed prior to being formed into tablets. When the unit dose is in the form of a tablet, the tablet is most commonly formed by compression of the powders and granules in a tablet mold. The tablets may be formed with the aid of tabletting aids, such as binders, disintegrants etc. Binders and disintegrants are described in Handbook of Pharmaceutical Excipients (1986). Optionally, the tablets may also comprise a coating, such as a dicarboxylic acid.

Typically each unit dose comprises between 10 g and 100 g of active components, more preferably between 30 g and 60 g.

EXAMPLES

Example 1 i) A detergent powder of composition A (see table 1) was prepared as follows: all the particulate materials of composition A were mixed together in a mixing drum to form a homogenous particulate mixture. During the mixing the binder was sprayed on.

ii) Tablets were then made in the following way. 42.3 g of the mixture was introduced into a mould of square shape with dimensions of 42×42 mm and compressed with a force of 1.5 kN by means of an Instron Press, to give a tablet density of about 1090 g/l. Afterwards, the pressed tablets were coated with a mix, melted at 175° C., containing 96.5% of a dicarboxylic acid (adipic acid) and 3.5% of a disintegrant (purolite). The total coating weight of the tablet was 2.6 g.

iii) A mix of 80% of nonionic surfactant Neodol AE7® and 20% of Lutensit KHD 96® was prepared, by heating the mix to 50° C. 0.74 g of this hot melt was applied to a sheet of polypropylene film of a thickness of 30 μm and of a dimension of 14.5×16 cm. The sheet was left to cool down for 24 hours, at ambient conditions. This treated sheet of polypropylene film can be used to wrap two of the tablets prepared in ii).

iv) A strip of a lipstick stain on a flat piece of knitted cotton was gently rubbed for 20 sec. with the sheet of polypropylene film prepared in iii).

v) The treated stain was washed with two of the tablets prepared in ii) under the following wash conditions: Miele Novotronic W831, short cycle, 40° C. After the wash, the washed strip was dried at ambient conditions for 12 hrs.

Example 2 i) Steps i) and ii) of example 1 were repeated.

ii) A mix of 70% of nonionic surfactant Neodol AE7®; 5% Dehydol C8EO4; 5% Limonene and 20% Polyethylene glycol, Pluriol 4000® was prepared, by heating the mix to 50° C. 0.85 g of this hot melt was applied to a sheet of polypropylene film of a thickness of 30 μm and of a dimension of 14.5×16 cm. The sheet was left to cool down for 24 hours, at ambient conditions. This treated sheet of polypropylene film can be used to wrap two of the tablets prepared in i).

iii) A strip of a lipstick stain on a flat piece of knitted cotton was gently rubbed for 20 sec. with the sheet of polypropylene film prepared in ii).

iv) The treated stain was washed with two of the tablets prepared in i) under the following wash conditions: Miele Novotronic W831, short cycle, 40° C. After the wash, the washed strip was dried at ambient conditions for 12 hrs.

Example 3 i) A detergent powder of composition B (see table 1) was prepared as described in step i) of example 1.

ii) Tablets were then made in the following way. 42.3 g of the mixture was introduced into a mould of square shape with dimensions of 42×42 mm and compressed with a force of 1.5 kN by means of an Instron Press to give a tablet density of about 1100 g/l. Afterwards, the pressed tablets were coated with a mix (melted at 175° C.) containing 96.5% of a dicarboxylic acid (adipic acid) and 3.5% of a disintegrant (purolite). The total coating weight of the tablet was 2.4 g.

iii) A strip of a lipstick stain on a flat piece of knitted cotton was washed with two of the tablets prepared in ii) under the following wash conditions: Miele Novotronic W831, short cycle, 40° C. After the wash, the washed strip was dried at ambient conditions for 12 hrs.

iv) The stain pairs (Example 1 vs. Example 3; Example 2 vs. Example 3) were visually graded according to the Scheffe scale. The results are shown in table 2. The results show that pre-treating the lipstick stain with the flowwrap of the present invention, results in a significantly higher level of stain removal versus the reference (example 3).

TABLE 1

Detergent base powder composition

| | Composition A (%) | Composition B (%) |
|---|---|---|
| Anionic agglomerates 1 | 22.266 | 22.266 |
| Anionic agglomerates 2 | 9.115 | 9.115 |
| Cationic agglomerates | 4.675 | 4.675 |
| Nonionic agglomerates | 6.15 | 9.129 |
| Citric acid | 4.67 | 4.67 |
| Layered silicate, SKS-6 ® | 9.757 | 9.757 |
| Sodium percarbonate | 12.266 | 12.266 |
| Bleach activator agglomerates | 6.093 | 6.093 |
| Sodium carbonate | 10.986 | 8.007 |
| EDDS/Sulphate particle | 0.495 | 0.495 |
| Tetrasodium salt of Hydroxyethane Diphosphonic acid | 0.82 | 0.82 |
| Soil release polymer | 0.363 | 0.363 |
| Fluorescer | 0.23 | 0.23 |
| Soap powder | 1.4 | 1.4 |
| Suds suppressor | 2.8 | 2.8 |
| Polyethylene glycol, Pluriol 4000 ® dry add | 2 | 2 |
| Protease | 0.967 | 0.967 |
| Lipase | 0.35 | 0.35 |
| Cellulase | 0.152 | 0.152 |
| Amylase | 1.134 | 1.134 |
| Perfume | 0.561 | 0.561 |
| Binder: | | |
| Sodium Di Iso Propyl Benzene Sulphonate | 0.75 | 0.75 |
| Lutensit KHD 96 ® | 0.75 | 0.75 |
| Polyethylene glycol, Pluriol 1000 ® | 0.39 | 0.39 |
| Polyethylene glycol, Pluriol 4000 ® | 0.86 | 0.86 |

Anionic agglomerates 1 comprises 40% AS/AE3S; 27% Zeolite A; 12% sodium carbonate; 9% maleic/acrylic copolymer; the balance being moisture and minor ingredients, impurities etc. Anionic agglomerates 2 comprises 20% AS/AE3S; 20 LAS; 28% Zeolite A; 20% sodium carbonate; the Cationic agglomerates comprises 20% quaternary ammonium compound; 64% Zeolite A; 10% sodium sulphate; the balance being moisture and minor ingredients, impurities etc. Nonionic agglomerates comprises 24% alkyl ethoxylate (AE7); 11% Zeolite A; 20% sodium carbonate; 36% sodium acetate; the balance being moisture and minor ingredients, impurities etc. Bleach activator agglomerates comprises 81% TAED; 17% acrylic/maleic copolymer and 2% water. Suds suppressor comprises 11.5% silicone oil; 4.5% hyfac; 13% TAE80 and 71% starch.

Fluorescer comprises 87% Brightener 47 (81% active) and 13% Brightener 49 (100% active).

Table 2. Stain Removal Performance

The scale mentioned in the table below was used to compare the level of stain removal.

| Score | Meaning |
|---|---|
| 0 | There is no difference |
| 1 | I think that this one is better |
| 2 | This one is better |
| 3 | This one is significantly better |
| 4 | This one is a whole lot better |

| Experiment | Score |
|---|---|
| Example 1 versus 3 | '3' in favor of example 1 |
| Example 2 versus 3 | '3' in favor of example 2 |

Example 4 i) A detergent powder of composition B (see table 1) was prepared as described in step i) of example 1 ii) Tablets were then made in the following way. 42.3 g of the mixture was introduced into a mould of square shape with dimensions of 42×42 mm and compressed with a force of 1.5 kN by means of an Instron Press, to give a tablet density of about 1050 g/l. Afterwards, the pressed tablets were coated with a mix (melted at 175° C.) containing 96.5% of a dicarboxylic acid (adipic acid) and 3.5% of a disintegrant (purolite). The total coating weight of the tablet was 2.5 g.

iii) 10 g of hexadecyl carboxymethyl cellulose produced by Metsa Specialty Chemicals was dispersed in 100 ml Polyethylene glycol, Pluriol 1000® at 50° C. Subsequently, a sheet of polypropylene film of a thickness of 30 μm and of a dimension of 14.5×16 cm was dipped into the hot melt. After dipping, the sheet was left to cool down at ambient conditions for 24 hrs. The amount of hexadecyl carboxymethyl cellulose deposited on the sheet was 1 g. This treated sheet of polypropylene film can be used to wrap two of the tablets prepared in ii).

iv) A cotton garment was cut in two. One half was washed with two of the tablets prepared in ii) together with the sheet of polypropylene film prepared in iii) under the following wash conditions: Miele Novotronic W831, short cycle, 30° C. After the wash, the garment was dried at ambient conditions for 12 hrs. This whole wash procedure was repeated 10 times.

Example 5 i) Tablets were made as described in example 4.

ii) The second half of the cotton garment described in step iv) of example 3, was washed with two of the tablets prepared in i) under the following wash conditions: Miele Novotronic W831, short cycle, 30° C. After the wash, the garment was dried at ambient conditions for 12 hrs. This whole wash procedure was repeated 10 times.

iii) Both halves (example 4 and 5) were visually assessed for pilling. The results are shown in table 3. The results show that washing the garment with the flowwrap of the present invention results in a significantly higher level of fabric integrity versus the reference (example 5).

Table 3. Fabric Integrity Performance

The scale mentioned in the table below was used to compare the level of fabric integrity of the garment prepared in example 4 and 5.

| Score | Meaning |
|---|---|
| 0 | There is no difference |
| 1 | I think that this one is better |
| 2 | This one is better |
| 3 | This one is significantly better |
| 4 | This one is a whole lot better |

| Experiment | Score |
|---|---|
| Example 4 versus 5 | '3' in favor of example 4 |

Example 6 i) Tablets were made as described in example 3, discussed hereinabove.

ii) A mix of 20% Polyethylene glycol, Pluriol 1000® and 80% of softness active tri-ethanol ester methyl ammonium methyl sulfate was prepared by heating the mix to 50° C. 2.5 g of this melt was applied to a sheet of polypropylene film of a thickness of 30 μm and of a dimension of 14.5×16 cm. The sheet was left to cool down at ambient conditions, for 24 hours. This treated sheet can be used to wrap two of the tablets prepared in i).

iii) A cotton garment was washed with two of the tablets prepared in i) under the following wash conditions: Miele Novotronic W831, short cycle, 30° C.

iv) After the wash, the garment was cut in two. One half was dried in a Miele Novotronic T490 in the presence of the sheet prepared in ii).

Example 7 i) The other half of the cotton garment, washed as explained in step iii) of example 5 was dried in a Miele Novotronic T490 without the sheet prepared in step ii) of example 5.

ii) The level of fabric softness of this half after the drying step was compared vs. example 5 (see above) via a softness test. The results are shown in table 4. The results show that drying the garment in the presence of a flow-wrap of the present invention, results in a significantly higher level of softness versus the reference (example 7).

Table 4. Fabric Conditioning Performance

The scale mentioned in the table below was used to compare the level of fabric softness of the garment prepared in example 6 and the garment prepared in example 7:

| Score | Meaning |
|---|---|
| 0 | There is no difference |
| 1 | I think that this one is better |
| 2 | This one is better |
| 3 | This one is significantly better |
| 4 | This one is a whole lot better |

The fabric conditioning (level of softness) result in this experiment is as follows:

| Experiment | Score |
|---|---|
| Example 6 vs. 7 | '3' in favour of example 6 |

What is claimed is:

1. A package for containing at least one unit dose in the form of at least one tablet of a detergent composition, wherein the package comprises a substrate and at least one fabric treatment chemical, and wherein the fabric treatment chemicals are released from the substrate through an action selected from the group consisting of temperature, friction, contact with water, and mixtures thereof:

a) wherein the fabric treatment chemical is impregnated into the substrate;

b) wherein the fabric treatment chemical is selected from the group consisting of:

i) surfactants for fabric stain pre-treatment;

ii) solvents for fabric stain pre-treatment;

iii) fabric softening agents;

iv) fabric integrity ingredients including carboxymethyl celluloses; and v) mixtures thereof and c) wherein the at least one tablet is wrapped into the impregnated substrate.

2. A package according to claim 1 wherein the fabric treatment chemicals are active during the laundry washing and/or drying processes.

3. A package according to claim 1 wherein the fabric treatment chemicals provide a residue on laundered fabrics.

4. A package according to claim 1, wherein the substrate is an insoluble polymeric film.

5. A package according to claim 1, wherein the substrate is selected from the group consisting of polyethylene, polypropylene, polyethylene terephthalate, polyvinyl chloride film, and mixtures thereof.

6. A package according to claim 5, wherein the substrate is a polyvinyl chloride film.

7. A package according to claim 1, wherein the substrate is a wet laid or air laid cellulosic substrate.

8. A package according to claim 1, wherein the substrate is sealed around the at least one unit dose of detergent composition so that the package is substantially impermeable to moisture.

9. A package according to claim 8, wherein the package further comprises a means for opening the sealed package.

10. A package for containing at least one unit dose in the form of at least one tablet of a detergent composition, wherein:

a) the package comprises a wet-laid or air-laid substrate and at least one fabric treatment chemical;

b) wherein the fabric treatment chemicals are released from the substrate through an action selected from the group consisting of temperature, friction, contact with water, and mixtures thereof;

c) wherein the substrate is selected from the group consisting of polyethylene, polypropylene, polyethylene terephthalate, polyvinyl chloride film, and mixtures thereof;

d) wherein the fabric treatment chemical is impregnated into the substrate and e) wherein the at least one tablet is wrapped into the impregnated substrate.

11. A package according to claim 10 where the fabric treatment chemical is selected from the group consisting of:

a) surfactants for fabric stain pre-treatment;

b) solvents for fabric stain pre-treatment;

c) fabric softening agents;

d) fabric integrity ingredients including carboxymethyl celluloses; and e) mixtures thereof.

12. A package according to claim 11 wherein the fabric treatment chemical is a fabric softening agent.

13. A method for treating fabrics, the method comprising the step of opening a package according to claim 1, and subsequently dissolving and/or dispersing the detergent composition to provide a wash liquor, wherein the chemical-impregnated substrate is being used to directly or indirectly apply the fabric treatment chemicals to the fabrics.

14. A method for treating textiles according to claim 13 wherein the chemical impregnated substrate is used for at least one step selected from the group consisting of:

a) pretreating stains on the fabrics, before washing the fabrics with the wash liquor comprising the detergent composition;

b) adding to the wash liquor, the wash liquor comprising the detergent composition; and c) adding to the dryer, after washing the fabrics with the wash liquor comprising the detergent composition.

* * * * *